United States Patent [19]

Fowler

[11] 4,225,837

[45] Sep. 30, 1980

[54] ARMATURE FOR A PROXIMITY SWITCH

[75] Inventor: Gerald L. Fowler, Louisville, Ky.

[73] Assignee: General Equipment & Mfg. Co., Inc., Louisville, Ky.

[21] Appl. No.: 973,863

[22] Filed: Dec. 28, 1978

[51] Int. Cl.[2] ..... H01H 9/00

[52] U.S. Cl. ..... 335/181; 335/182; 335/207

[58] Field of Search ..... 335/78, 79, 80, 177, 335/181, 182, 205, 207

[56] References Cited

U.S. PATENT DOCUMENTS

| | | | |
|---|---|---|---|
| 2,793,265 | 5/1957 | Crissinger | 335/205 X |
| 3,176,096 | 3/1965 | Marcum | 335/182 |
| 3,325,756 | 6/1967 | Maxwell | 335/207 X |

FOREIGN PATENT DOCUMENTS

| | | | |
|---|---|---|---|
| 892404 | 4/1944 | France | 335/181 |
| 167839 | 7/1959 | Sweden | 335/181 |

*Primary Examiner*—George Harris

*Attorney, Agent, or Firm*—Maynard C. Yeasting

[57] ABSTRACT

A magnetically actuated proximity device or switch is provided with an armature formed as a shallow U that is pivoted at its center and arranged with the legs of the U directed toward the pole faces of a pair of permanent magnets. The particular shape increases the sensitivity of the device and the force available for operating contacts or other output devices in response to the diversion of flux from an end of the armature.

3 Claims, 2 Drawing Figures

ARMATURE FOR A PROXIMITY SWITCH

BACKGROUND OF THE INVENTION

Magnetically actuated proximity switches have been used to sense the relative movement between two member, one carrying the switch and the other being a magnetically permeable member, usually iron or steel. A major problem in the design of magnetically actuated proximity switches is to get adequate pressure between the electrical contacts of the device at reasonable sensing distances. This invention relates to an improvement in a magnetically actuated switch such as that shown in FIG. 5 of U.S. Pat. No. 3,176,096, issued to Charles R. Marcum. Specifically the control member or armature is improved to increase the sensitivity and the contact pressure between the contacts of the device in response to a given diversion of flux from the armature of the device.

In a proximity switch according to the invention the control member or armature, which carries the movable contacts, is provided at its ends with magnetically permeable lips extending toward the marginal area of the pole faces of the permanent magnets with which the armature cooperates.

A preferred form of the invention is illustrated in the accompanying drawings.

Figure 1:
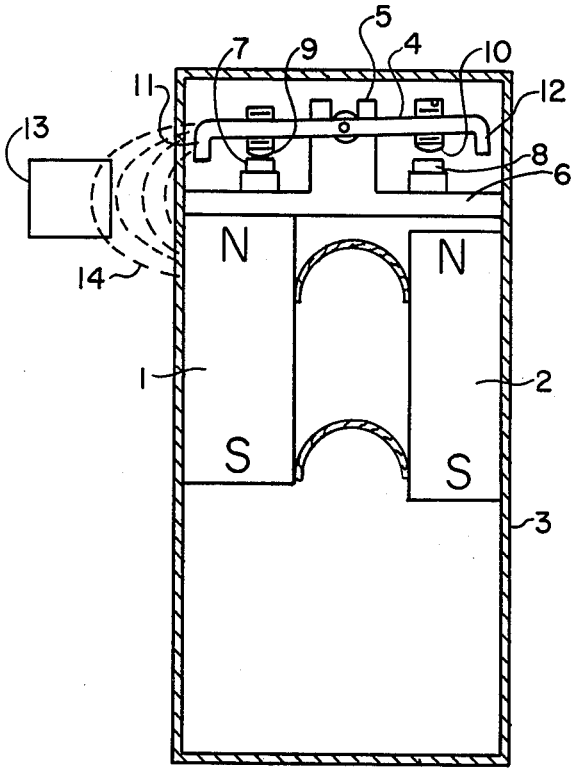
FIG. 1 is a longitudinal section showing a preferred form of the invention.
Figure 2:
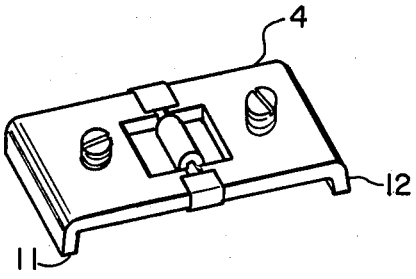
FIG. 2 is a pictorial view of the improved armature.

These specific figures and the accompanying description are intended to illustrate the invention but not to impose limitations on the claims.

DESCRIPTION OF A PREFERRED EMBODIMENT

A magnetically actuated proximity switch constructed according to the invention comprises a pair of permanent magnets 1, 2 mounted in a spaced parallel arrangement within a case 3. An armature 4 is pivotally mounted on a pedestal 5 erected from a partition 6 located at one end of the magnets 1, 2. A pair of contacts 7, 8 are resiliently mounted on the partition 6 and are connected, by means not shown, to suitable terminals in the case 3.

The armature 4 includes a pair of contacts 9, 10 that cooperate with the contacts 7 and 8. A suitable flexible connection, not shown, electrically connects the armature to a suitable terminal in the case 3.

The armature 4 includes a pair of lips 11, 12 projecting generally normal to the plane of the armature. It thus differs from the flat armatures used in relays and in the proximity switch shown in the Marcum patent. The lips extend the full width of the armature thus forming a shallow U-shaped member. In the mounted position the lips are directed toward the adjacent ends of the magnets 1 and 2.

In a practical embodiment of the invention the armature 4 is approximately one and one fourth inches long, three fourths of an inch wide and a sixteenth of an inch thick. The lips extend about an eighth to three sixteenths of an inch normal to the plane of the body of the armature.

As may be noted from FIG. 1, the permanent magnet 2 is separated from the partition 6 about a sixteenth of an inch more than the magnet 1. Thus the air gap between the magnet 2 and the armature lip 12 is slightly greater than the gap between the magnet 1 and the lip 11. The shorter air gap provides greater pull so that, without an exterior operator, the armature is biased to the position shown, i.e. with the contacts 7 and 9 in contact.

Upon the entry of a body 13 of ferromagnetic material into the space adjacent the gap between magnet 1 and armature lip 11, the approximate boundary of which space is indicated by dotted line 14, magnetic flux is diverted from the gap and the magnetic pull weakened. Thereupon the armature moves in response to the now stronger pull between magnet 2 and lip 12.

When compared with a switch using a flat armature, as shown in Marcum Pat. No. 3,176,096, the new arrangement and armature shape provides an increase in contact pressure in the order of 50%. Conversely, if a given contact pressure is required the improved armature provides a substantial increase in sensing distance, i.e. the distance from the case 3 at which a given ferromagnetic body 13 causes a movement of the armature 4.

What is claimed is:

1. In a magnetic proximity device, in combination, a pivotally mounted magnetically permeable armature, a first permanent magnet having a pole of a first kind positioned adjacent a first end of the armature and urging said armature to rotate in a first direction, a second permanent magnet having a pole of a first kind adjacent a second end of the armature and urging said armature to rotate in a second direction, said armature being movable from a first position to a second position when magnetic flux is diverted from the armature by approach of a magnetically permeable operator, and a pair of magnetically permeable lips depending from the ends of said armature toward said magnets for concentrating the flux of the magnets at the ends of the armature, whereby the diversion of flux from the armature by an external magnetically permeable operator is increased.

2. A magnetically operated proximity switch according to claim 1 in which said lips are integral portions of the armature extending normally from the plane of the pivoted portion of the armature toward the adjacent magnet.

3. A magnetically operated proximity switch according to claim 1 in which said armature extends across the pole faces of the magnets with the lips directed toward the outer marginal areas of the magnet faces.

* * * * *